US006113211A

United States Patent [19]

Imai

[11] Patent Number: 6,113,211

[45] Date of Patent: Sep. 5, 2000

[54] INK JET RECORDING DEVICE

[75] Inventor: Koji Imai, Nagoya, Japan

[73] Assignee: Brother Kogyo Kabushiki Kaisha, Nagoya, Japan

[21] Appl. No.: 08/780,940

[22] Filed: Jan. 10, 1997

[30] Foreign Application Priority Data

Jan. 11, 1996 [JP] Japan ..... 8-021896

[51] Int. Cl.[7] ..... B41J 29/38

[52] U.S. Cl. ..... 347/17

[58] Field of Search ..... 347/17, 18, 14, 347/7, 60

[56] References Cited

U.S. PATENT DOCUMENTS 5,109,234 4/1992 Otis, Jr. et al. ..... 347/60
5,373,366 12/1994 Bowers ..... 347/7
5,745,132 4/1998 Hirabayashi et al. ..... 347/14

FOREIGN PATENT DOCUMENTS 62-249745 10/1987 Japan .
7-266564 10/1995 Japan .

*Primary Examiner*—John Barlow
*Assistant Examiner*—Charles W. Stewart, Jr.
*Attorney, Agent, or Firm*—Oliff & Berridge, PLC

[57] ABSTRACT

A recording device including a recording head for recording on a recording medium; a drive motor; a temperature detection circuit for detecting temperature of the recording head and outputting an analog signal corresponding to the detected temperature; a conversion circuit for converting the analog signal into a digital signal; and a CPU for receiving the digital signal from the conversion circuit only when at least one of the recording head and the drive motor are not being driven and for controlling energy applied to the recording head based on the received digital signal.

14 Claims, 5 Drawing Sheets

INK JET RECORDING DEVICE

BACKGROUND OF THE INVENTION

1. Field of the Invention

The present invention relates to an ink jet recording device and more particularly to controlling drive of a recording head according to ambient environment, such as ambient temperature of the recording head.

2. Description of the Related Art

In an ink jet recording device including a recording head for ejecting ink droplets, when ambient environment, such as ambient temperature, of the recording head changes, then viscosity of the ink, and consequently the ejection characteristic of ejected ink droplets, will change. Conventionally, the ambient temperature and the like of the recording head is detected so that the ejection characteristic of ink droplets can be corrected by driving the recording head in correspondence with changes in temperature of the ink. A thermistor attached to the recording head is used to detect the ambient temperature of the recording head. The thermistor outputs, via a flexible cable, an analogue detection signal to an A/D conversion port of the central processing unit (CPU) provided on the main substrate. The CPU controls ejection of ink droplets based on the detection signal.

SUMMARY OF THE INVENTION

Noise is generated when the drive motors for the recording head and the carriage are driven, when the line feed motor is driven, and when data is transmitted from the CPU to the recording head driver. Such noise can adversely affect the detection signal so that the analogue signal from the thermistor does not accurately represent the actual environment of the recording head.

It is an objective of the present invention to overcome the above-described problems and to provide a recording device capable of accurately detecting temperature and the like of the recording head without receiving adverse effects from noise generated when data is transmitted from the CPU to the recording head and when various motors are being driven.

In order to achieve these objectives, a recording device according to the present invention includes a recording head for recording on a recording medium; a drive source; an environment detection means for detecting environment of the recording head and outputting an analog signal corresponding to the detected environment; a conversion means for converting the analog signal into a digital signal; and a control means for receiving the digital signal from the conversion means only when at least one of the recording head and the drive source are not being driven and for controlling energy applied to the recording head based on the received digital signal.

With this configuration, the control means receives the detection signal from the environmental detection means only when none of the other drive sources and the print head are being driven and controls application of energy to the print head accordingly. The control means is able to control application of energy to the print head based on a detection signal uninfluenced by noise from the print head or the drive sources. As a result, error in the detection of ambient environment of the print head can be reduced and the recording head can be accurately driven according to changes in viscosity of ink brought about by changes in the ambient environment of the print head, resulting in high quality printing.

According to another aspect of the present invention, a recording device includes a recording head for recording on a recording medium; a drive source; an environment detection means for detecting environment of the recording head and outputting an analog signal corresponding to the detected environment; a conversion means for converting the analog signal into a digital signal; and a control means for controlling the conversion means to convert the analog signal to a digital signal only when at least one of the recording head and the drive source are not being driven, for receiving the digital signal from the conversion means, and for controlling energy applied to the recording head based on the digital signal.

With this configuration, the control means controls the conversion means to convert the analogue detection signal to the digital detection signal only when none of the print head or the other drive sources are being driven. In this case, the conversion means will convert into a digital signal only those analogue signals outputted from the environmental detection means unaffected by noise generated by the recording head and the other drive sources. Therefore, the control means can receive an accurate digital signal based on the detection of the ambient temperature of the print head or the temperature of the ink and control application of energy to the print head based on the ambient temperature of the print head or temperature of the ink. This also results in reduction of detection errors and accurate control according to changes in ink viscosity.

According to another aspect of the present invention, the environmental detection means detects the ambient temperature of the recording head or the temperature of the ink in the recording head. The control means receives a detection signal from the environmental detection means and controls the voltage waveform applied to the recording head accordingly.

According to still another aspect of the present invention, the environment detection means detects the temperature of a recording head driver and the control means receives the digital signal based on detection by the environment detection means and controls non-driving times of the recording head accordingly. As a result, the temperature of the recording head driver can be accurately detected and the non-driving times of the recording head can be controlled based on the accurate temperature detection. Whether or not the recording driver has heated up to an abnormally high temperature can be accurately detected and drive of the recording head accurately stopped so that the recording head driver can be properly protected.

Errors in detection of ambient environment of the recording head can be reduced and control of drive of the recording head can be accurately performed according to change in ink viscosity when the control means controls drives of the recording head when a carriage motor or a transport motor of the printer is not being driven. The same effects can be achieved when the recording head is an ink jet print head. Additionally, ink ejection can be maintained at a good level so that the print quality is high.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
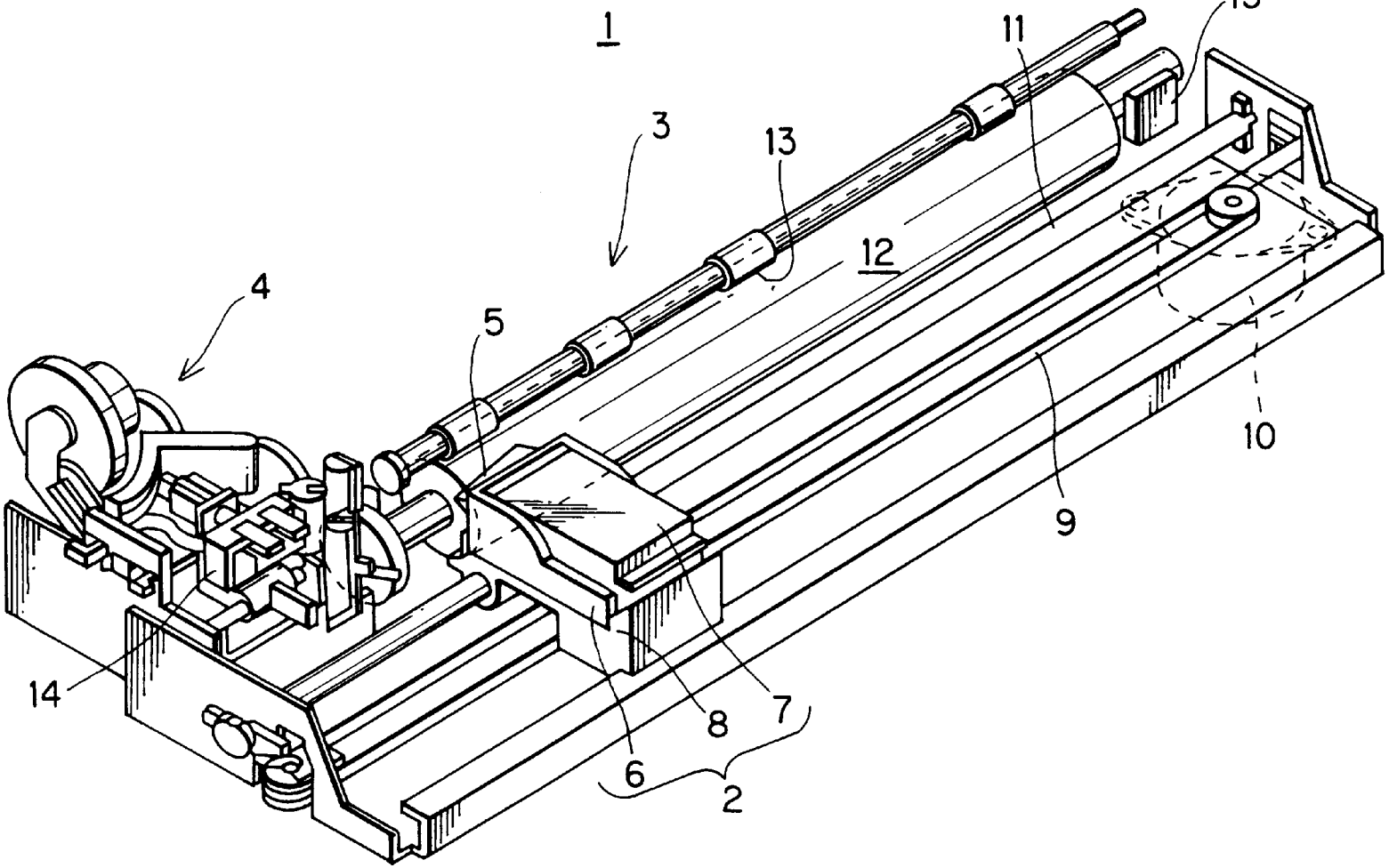
FIG. 1 is a perspective view showing internal configuration of a printer according to an embodiment of the present invention.

An ink jet recording device according to a preferred embodiment of the present invention will be described while referring to the accompanying drawings wherein like parts and components are designated by the same reference numerals to avoid duplicating description.

FIG. 1 is a perspective view showing internal configuration of a printer 1 according to the present embodiment of the present invention. The printer 1 includes a print mechanism 2, a sheet-feed mechanism 3, and a purge unit 4.

Figure 2:
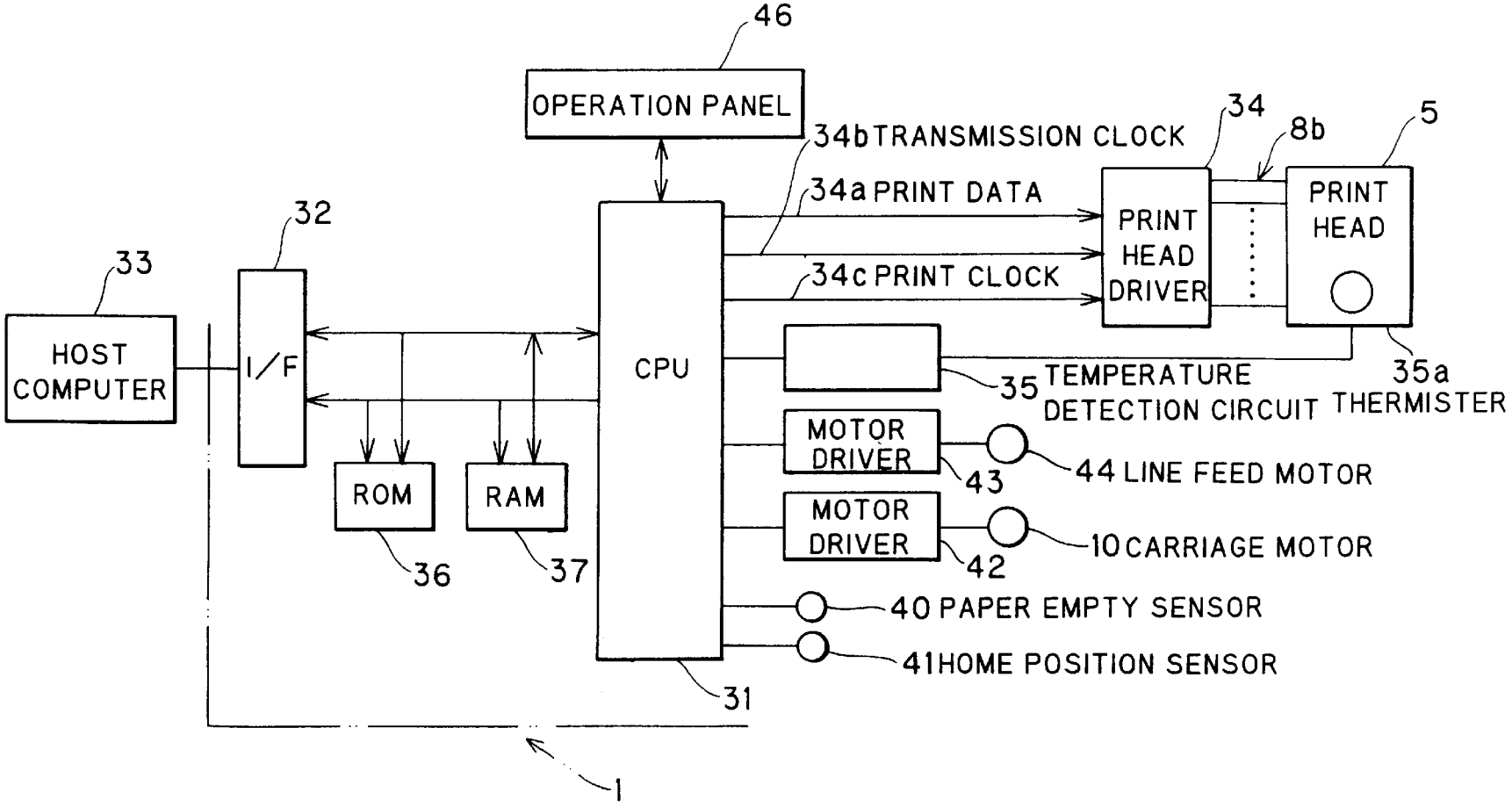
FIG. 2 is a block diagram showing a control system of the printer of FIG. 1.
Figure 3:
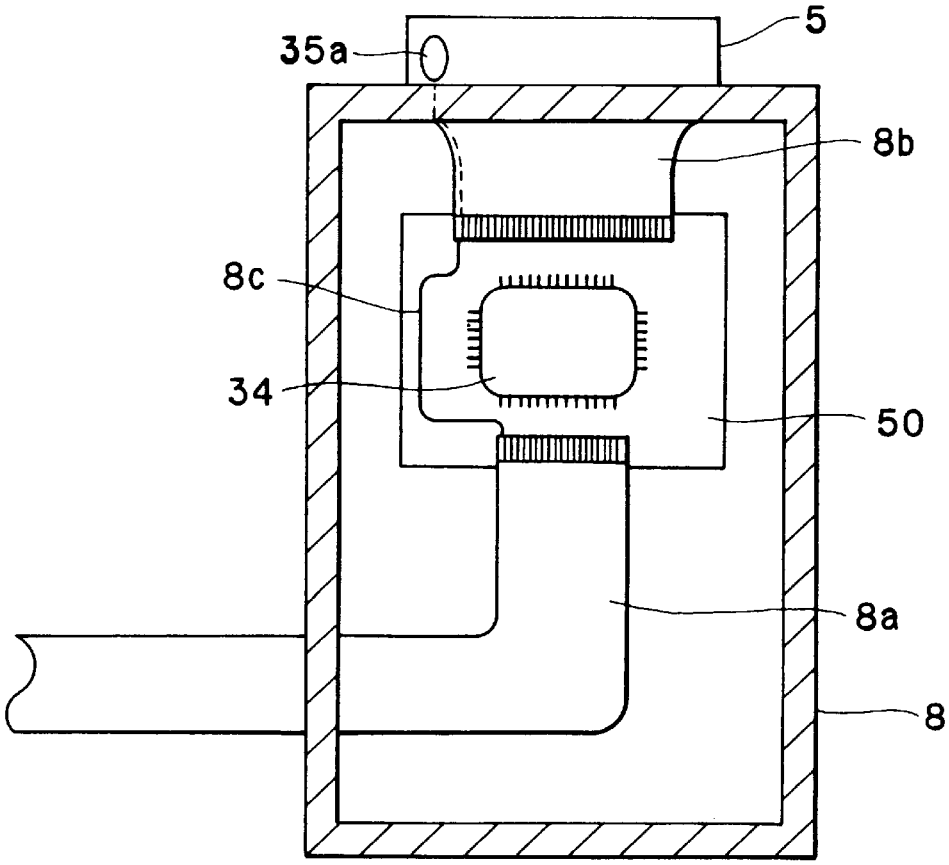
FIG. 3 is a cross-sectional view showing the internal configuration of a carriage of the printer.

The print mechanism 2 includes a head unit 6 having an ink jet print head 5; an ink cartridge 7 for supplying ink to the print head 5; and a carriage 8 on which are mounted the head unit 6 and the ink cartridge 7. The carriage 8 is mounted horizontally slidable on a carriage shaft 11 and is connected to a carriage motor 10 by a belt 9 so that the carriage 8 can be reciprocally driven along the carriage shaft 11 by drive of the carriage motor 10. The print head 5 includes a plurality of nozzles through which ink is ejected in correspondence with movement of the carriage 8. As shown in FIG. 2, a thermistor 35*a* is provided in the print head 5. As shown in FIG. 3, the carriage 8 includes a flexible cable (FPC) 8*a* for transmitting print data signals and the like from a CPU 31 of the printer 1.

The sheet-feed mechanism 3 includes a platen roller 12, a pressure roller 13, and a line feed motor 44 (shown in FIG. 2). The sheet-feed mechanism 3 is for transporting, in confrontation with the print head 5, a print sheet supplied either from a sheet-supply cassette or a manual sheet-supply portion. The supplied print sheet is pressed between the platen roller 12 and the pressure roller 13 and supported therebetween. The print sheet is moved in association with rotation of the line feed motor 44.

The purge unit 4 including a cap 14 at its tip is provided for overcoming problems, such as defective ejection of ink caused by ink droplets clinging to the ejection plate surface of the ink jet print head 5 and vapor bubbles generated within the ink jet print head 5 during its use, in order to return the ink jet print head 5 to a good ejection condition. When the purge unit 4 is operated, the cap 14 covers the print head 5 and a pump (not shown in the drawings) is activated to induce negative pressure within the cap 14. The negative pressure sucks defective ink from out of the print head 5 so that the print head 5 is returned to a good ejection condition. To maintain all the nozzles of the print head 15 in a good ejecting condition, a flushing operation is performed wherein ink is ejected from all the nozzles in a non-printing operation. An ejected ink absorption body 15 is provided to absorb ink ejected during the flushing operation.

Next, an explanation will be provided for a control system of the printer 1 while referring FIG. 2. FIG. 2 is a block diagram showing the control system of the printer 1. The printer 1 includes the CPU 31 for controlling various components of the printer 1; a print head driver 34 for driving the print head 5; and a temperature detection circuit 35 for detecting temperature of the print head based on a value obtained from the thermistor 35*a*. The CPU 31 serves as a control means for receiving print data from a host computer 33 via an interface (I/F) 32. The CPU 31 also controls drive of the print head 5 according to temperature of the print head 5, that is, based on a voltage value corresponding to temperature detected by the temperature detection circuit 35. The print head driver 34 operates to drive the print head 5 based on print data 34*a*, a transmission clock 34*b*, and a print clock 34*c* outputted from the CPU 31. A detailed description for the thermistor 35*a* and the temperature detection circuit 35 will be described later.

The CPU 31 is connected to a ROM 36 storing various operation programs and to a RAM 37 for temporarily storing, as image data, the print data which the CPU 31 receives from the host computer 33. Reception of necessary data is performed between the CPU 31, ROM 36, RAM 37. The CPU 31 also receives necessary data from a paper empty sensor 40 for detecting whether or not print sheets are available, and a home position sensor 41 for detecting whether or not the print head 5 is in its home position. A motor driver 42 is provided for the carriage motor 10. A motor driver 43 is provided for driving the line-feed motor 44. The CPU 31 is connected to control the motor drivers 42, 43. An operation panel 46 for supplying the CPU 31 with a variety of signals is connected to the CPU 31.

Next, the internal configuration of the carriage 8 will be explained while referring to FIG. 3. FIG. 3 is a cross-sectional view showing the internal configuration of the carriage 8. A carriage substrate 50 is provided in the carriage 8. A print head driver 34 for driving the print head 5 is provided with other components on the carriage substrate 50. The carriage substrate 50 is connected to the print head 5 by a flexible cable 8*b*. The carriage substrate 50 is connected to the CPU 31 by a flexible cable 8*a*. Because the thermistor 35*a* is provided in the print head 5, the resistance value of the thermistor 35*a* changes with ambient temperature of the print head 5. Therefore, by providing the thermistor 35*a* to the print head 5, changes in ambient temperature of the print head 5 can be detected by detecting, as voltage values, changes in the resistance value of the thermistor 35*a*. The temperature detected by the thermistor 35*a* is outputted as an analogue signal to the temperature detection circuit 35 via a line 8*c* of the flexible cables 8*a*, 8*b*. The analogue signal is used by the temperature detection circuit 35 to detect temperature of the print head 5. After the temperature detection circuit converts the analogue signal to a digital signal, it outputs the digital signal to a digital input port of the CPU 31.

Figure 4:
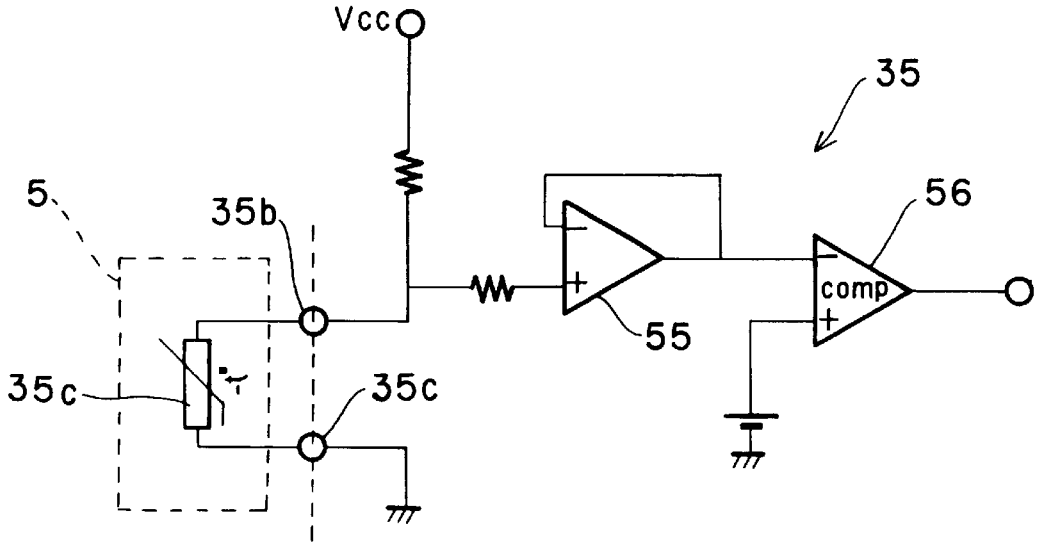
FIG. 4 is a circuitry diagram showing the configuration of a temperature detection circuit of the printer.

Next, an explanation will be provided for the temperature detection circuit 35 while referring to FIG. 4. FIG. 4 is a block diagram showing the internal configuration of the temperature detection circuit 35. The thermistor 35*a* provided to the print head 5 is connected to a power source Vcc via a contact point 35*b* and to ground via a contact point 35*c*. The power source Vcc energizes the thermistor 35*a*. The temperature detection circuit 35 detects temperature of the print head 5 based on the detected voltage value, which corresponds to the resistance value of the energized thermistor 35*a*. The temperature detection circuit 35 includes a buffer amp 55 for amplifying the detected voltage value, and a compilator for detecting whether or not the voltage value is higher or lower than a reference voltage value, that is, whether or not the temperature of the print head 5 is above or below a predetermined value. Compared output from the compilator 56 is outputted to the digital input port of the CPU 31 as a digital signal. The CPU 31 controls drive of the print head 5 by controlling the voltage waveform applied to the print head 5 based on the digital signal. In this way, the CPU 31 can control drive of the print head 5 according to changes in viscosity of the ink brought about by changes in temperature of the print head 5. As a result, variation in ejection characteristic of ink from the print head 5 caused by viscosity of ink can be reduced.

The detection results from the thermistor 35*a* can be outputted to the analogue input port of the CPU 31 as an analogue signal. In this case, the compilator 56 can be dispensed with and the signal outputted from the buffer amp 55 of the temperature detection circuit 35 can be outputted directly to the analogue input port of the CPU 31. The CPU 31 then converts the analogue signal to a digital signal. Afterwards, the CPU 31 controls drive of the print head 5 based on the converted digital signal.

Figure 5:
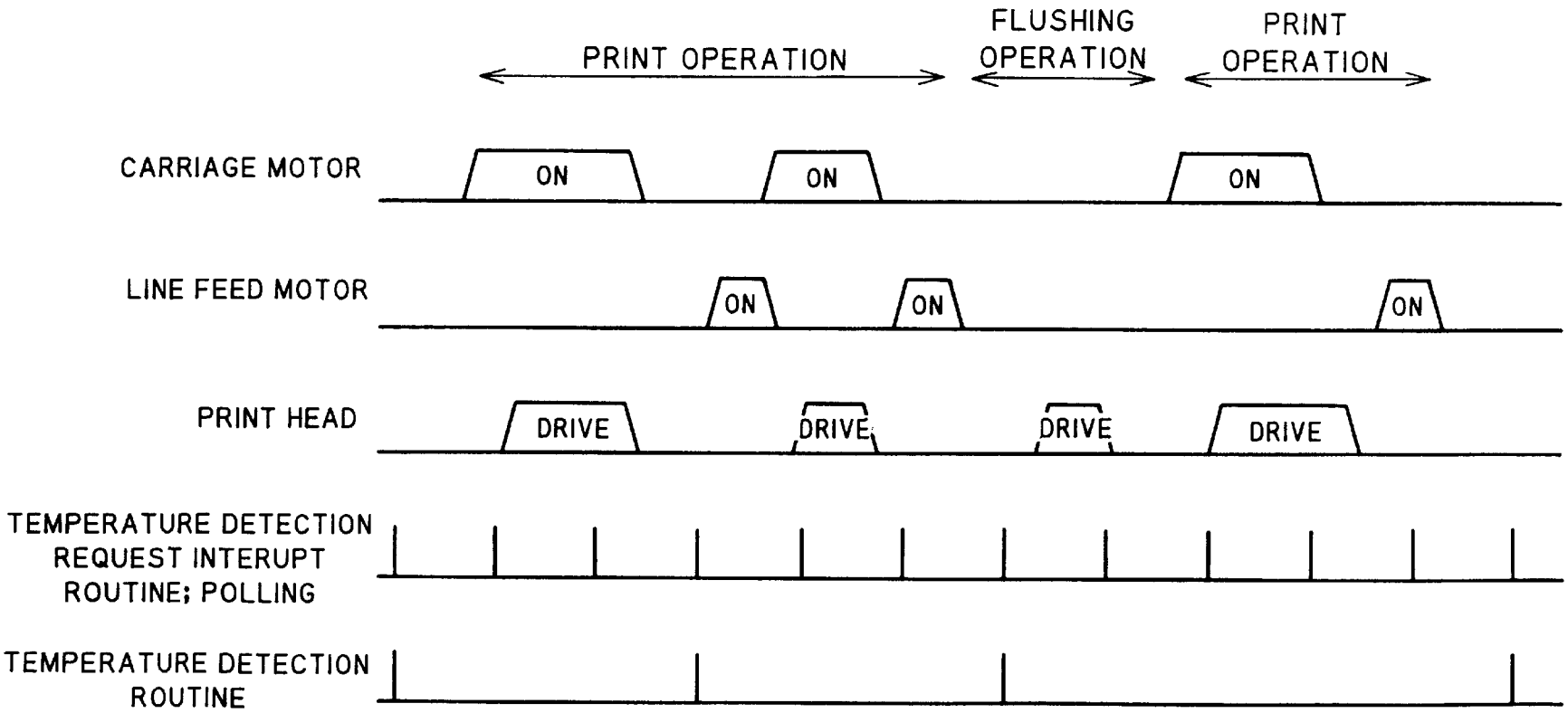
FIG. 5 is a timing chart showing timing of polling and temperature detection processes with respect to drive of a carriage motor, a line feed motor, and a print head of the printer.

Next, an explanation of timing when the CPU 31 receives the digital signal from the temperature detection circuit 35 dependent on a polling process will be provided while referring to the timing chart of FIG. 5. Reception of the digital signal from the temperature detection circuit 35 is controlled to be performed only when none of the carriage motor 10, the line-feed motor 44, and the print head 5 are being driven. An interrupt request for reception of the digital signal is sent to the CPU 31 each time a predetermined duration of time elapses. When the CPU 31 receives this interruption request, it performs the interrupt routine shown in FIG. 6. During the interrupt routine, the CPU 31 performs polling to investigate whether or not the carriage motor 10, the line-feed motor 44, and the print head 5 are being driven. Only when none of these are being driven will the CPU 31 receive detection data from the temperature detection circuit 35.

The reason for the CPU 31 controlling in this manner is that the voltage value of the analogue signal generated by the thermistor 35*a* is easily affected by noise generated when the carriage motor 10 and the line-feed motor 44 are being driven and when the print data is being transmitted to the print head 5. Because the voltage value from the thermistor 35*a* is easily affected by this noise, the temperature detection circuit 35 can not accurately detect temperature during these events. When the CPU 31 controls in the above-described manner, it receives detection signals from the temperature detection circuit 35 based on accurate voltage values unaffected by noise. Therefore, the CPU 31 receives only digital signals that accurately represent the detected temperature.

It should be noted that the CPU 31 need not control by an interrupt routine wherein the CPU 31 only receives the detection signal when drive sources are not being driven. For example, the CPU 31 can control the temperature detection circuit 35 to convert the analogue signal to a digital signal and transmit its digital signal only when the drive sources are not being driven. The CPU 31 can receive this digital signal and perform its control accordingly. Because the temperature detection circuit 35 only transmits its digital signal when no other drive source is operating, the CPU 31 can accurately control the print head 5.

Figure 6:
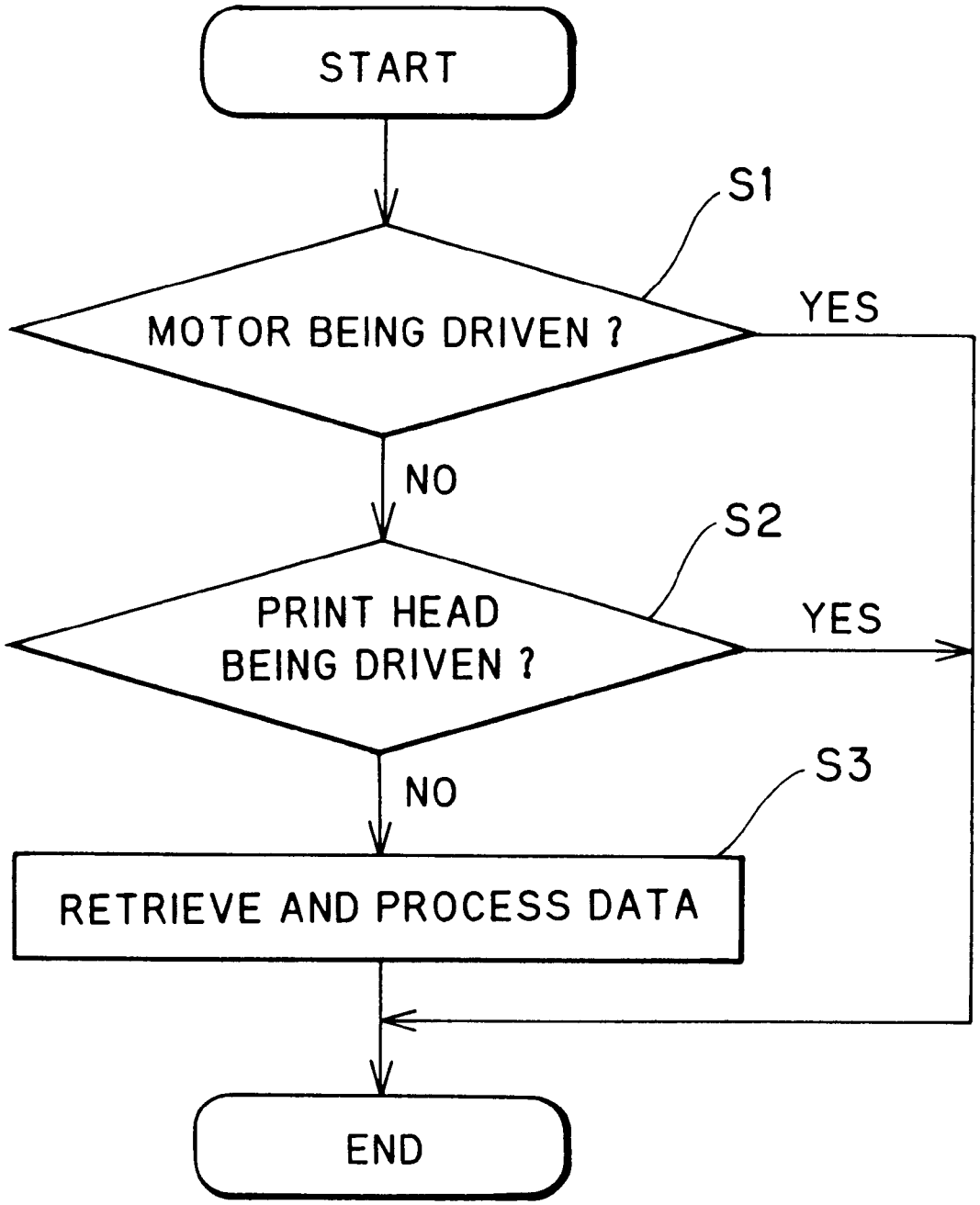
FIG. 6 is a flowchart showing a polling routine performed by a central processing unit of the printer.

Next, the polling processes performed by the CPU 31 will be explained while referring to FIG. 6. FIG. 6 is a flowchart showing flow of polling processes performed by the CPU 31. When the CPU 31 receives an interrupt request, it investigates in S1 whether or not the carriage motor 10 or the line-feed motor 44 are being driven. If either the carriage motor 10, the line-feed motor 44, or both are being driven (S1:YES), then this process is ended and the CPU 31 does not receive the detection signal. On the other hand, when neither the carriage motor 10 nor the line-feed motor 44 is being driven (S1:NO), then the CPU 31 investigates whether or not the print head 5 is being driven in S2. If the print head 5 is being driven (S2:YES), then this routine is ended so that the CPU 31 does not receive a detection signal. On the other hand, if the print head 5 is not being driven (S2:NO), then in S3 the CPU 31 receives the detection signal from the temperature detection circuit 35, retrieves the temperature detection data, and controls drive of the print head 5 based on the temperature detection data.

In summary, in the printer 1 according to the present embodiment, the temperature of the print head 5 is detected by the thermistor 35*a* and the temperature detection circuit 35. The compilator 56 provided in the temperature detection circuit 35 investigates whether voltage of the detection signal is higher or lower than a predetermined reference voltage value, converts the analogue signal to digital signal, and outputs the digital signal to the CPU 31. The CPU performs polling to determine whether the print head 5, the carriage motor 10, and the line-feed motor 44 are being driven the CPU 31 and receives the digital signal only when they are not being driven. The CPU 31 then controls the drive of the print head 5 based on the digital signal. As a result, the CPU 31 receives an accurate digital signal converted from an analogue signal unaffected by noise generated by drive of the print head 5, the carriage motor 10, and the line-feed motor 44. Therefore, the CPU 31 can accurately control drive of the print head 5 in accordance in temperature.

While the invention has been described in detail with reference to specific embodiments thereof, it would be apparent to those skilled in the art that various changes and modifications may be made therein without departing from the spirit of the invention, the scope of which is defined by the attached claims.

For example, in the embodiment, the thermistor 35*a* and the temperature detection circuit 35 detect the ambient temperature of the print head 5 and the CPU 31 controls drive of the print head 5 based on the results of this detection. However, the thermistor 35*a* and the temperature detection circuit 35 could be used to detect the temperature of the ink in the ink cartridge 7 instead. The CPU would control drive of the print head 5 based on the detected ink temperature. In this case, the thermistor 35*a* would be provided in the ink cartridge 7. The output from the thermistor would be electrically connected to the temperature detection circuit by connected contact points provided to the side surfaces of the ink cartridge and the carriage.

Alternatively, the thermistor 35*a* and the temperature detection circuit 35 could be used to detect the temperature of the print head driver 34. The CPU 31 could then control non-drive times of the print head 5 based on these detection results. With this configuration, when the print head driver 34 reached an unusually high temperature, the CPU 31 could stop drive of the print head 5 in order to protect the print head driver 34 from temperature damage. The CPU 31 could stop drive of the print head 5 based on an accurate digital signal from the temperature detection circuit 35.

In the above-described embodiment, the CPU 31 is described as receiving the digital signal from the temperature detection circuit 35 only when none of the print head 5, the carriage motor 10, and the line-feed motor 44 are being driven. However, the CPU 31 could determine whether or not a selected one of the print head 5, the carriage motor 10, and the line-feed motor 44 is being driven, and control whether or not the digital signal from the temperature detection circuit 35 is received based on this determination.

What is claimed is:

1. A recording device comprising:

a recording head that records on a recording medium by ejecting ink when applied with energy;

at least one component that is driven by a corresponding at least one drive source when the corresponding at least one drive source is applied with energy;

an environment detector that periodically detects an environment in which the recording head is disposed and outputs an analog signal corresponding to the environment;

a converter that converts the analog signal into a digital signal, noise being introduced into the analog signal from at least one of the recording head and the at least one drive source, said noise generated when at least one of the recording head and the at least one drive source is applied with energy; and a controller that periodically detects whether the recording head and a predetermined one of the at least one drive source are being applied with energy, the controller receiving the digital signal from the converter only at times when the controller detects that the recording head and the predetermined one of the at least one drive source are not being applied with energy, the controller controlling application of energy to the recording head by changing energy used to eject ink based on the received digital signal.

2. A recording device as claimed in claim 1, wherein the environment detector detects at least one of a temperature of ink in the recording head and an ambient temperature of the recording head; and wherein the controller controls, based on the temperature detected by the environment detector, a voltage waveform applied to the recording head.

3. A recording device as claimed in claim 2, further comprising a carriage on which the recording head is mounted, wherein the predetermined one of the at least one drive source comprises a carriage motor that moves the carriage.

4. A recording device as claimed in claim 1, further comprising a recording head driver that drives the recording head and wherein the environment detector detects a temperature of the recording head driver, the controller controlling, based on the temperature detected by the environment detector, a non-driven time of the recording head.

5. A recording device as claimed in claim 4, further comprising a carriage on which the recording head is mounted, wherein the predetermined one of the at least one drive source comprises a carriage motor that moves the carriage.

6. A recording device as claimed in claim 1, further comprising a carriage on which the recording head is mounted, wherein the predetermined one of the at least one drive source comprises a carriage motor that moves the carriage.

7. A recording device as claim in claim 1, wherein the recording head is an ink jet print head for recording by ejecting droplets onto the printing medium.

8. A recording device as claimed in claim 1, wherein the controller detects whether the recording head and drive source are being driven using polling.

9. A recording device comprising:

a recording head that records on a recording medium by ejecting ink when applied with energy;

at least one component that is driven by a corresponding at least one drive source when the corresponding at least one drive source is applied with energy;

an environment detector that periodically detects an environment in which the recording head is disposed and outputs an analog signal corresponding to the environment;

a converter that converts the analog signal into a digital signal, noise being introduced into the analog signal from at least one of the recording head and the at least one drive source, said noise generated when at least one of the recording head and the at least one drive source is applied with energy; and a controller that periodically detects whether the recording head and a predetermined one of the at least one drive source are being applied with energy, the controller controlling the converter to convert the analog signal to the digital signal only at times when the controller detects that the recording head and the predetermined one of the at least one drive source are not being applied with energy, the controller receiving the digital signal from the converter, and the controller controlling application of energy to the recording head by changing energy used to eject ink based on the received digital signal.

10. A recording device as claimed in claim 9, wherein the environment detector detects at least one of a temperature of ink in the recording head and an ambient temperature of the recording head; and wherein the controller controls, based on the temperature detected by the environment detector, a voltage waveform applied to the recording head.

11. A recording device as claimed in claim 10, further comprising a carriage on which the recording head is mounted, wherein the predetermined one of the at least one drive source comprises a carriage motor that moves the carriage.

12. A recording device as claimed in claim 9, further comprising a recording head driver that drives the recording head and wherein the environment detector detects a temperature of the recording head driver, the controller controlling, based on the temperature detected by the environment detector, a non-driven time of the recording head.

13. A recording device as claimed in claim 9, further comprising a carriage on which the recording head is mounted, wherein the predetermined one of the at least one drive source comprises a carriage motor that moves the carriage.

14. A recording device as claimed in claim 13, wherein the controller detects whether the recording head and drive source are being driven using polling.

* * * * *